US007783226B2

(12) United States Patent
Tomatsu

(10) Patent No.: US 7,783,226 B2
(45) Date of Patent: Aug. 24, 2010

(54) IMAGE FORMING APPARATUS

(75) Inventor: Yoshiya Tomatsu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 709 days.

(21) Appl. No.: 11/564,592

(22) Filed: Nov. 29, 2006

(65) Prior Publication Data

US 2007/0160382 A1 Jul. 12, 2007

(30) Foreign Application Priority Data

Nov. 29, 2005 (JP) ..... 2005-344330

(51) Int. Cl.
*G03G 15/00* (2006.01)

(52) U.S. Cl. ..... 399/107; 399/111; 399/121; 399/122

(58) Field of Classification Search ..... 399/107; 347/138, 152, 170, 222, 245, 263
See application file for complete search history.

(56) References Cited

U.S. PATENT DOCUMENTS

| | | | | |
|---|---|---|---|---|
| 5,625,437 | A | 4/1997 | Furukawa | |
| 5,787,324 | A | 7/1998 | Iwasaki | |
| 5,887,225 | A | 3/1999 | Bell | |
| 6,128,100 | A * | 10/2000 | Uemura et al. | 358/401 |
| 6,282,395 | B1 | 8/2001 | Nittani et al. | |
| 6,285,851 | B1 | 9/2001 | Kojima et al. | |
| 6,356,730 | B1 | 3/2002 | Nonaka | |
| 6,427,310 | B1 * | 8/2002 | Kerr | 347/263 |
| 6,476,843 | B1 * | 11/2002 | Kerr | 347/222 |
| 6,928,251 | B2 | 8/2005 | Yoshihara et al. | |
| 7,051,941 | B2 | 5/2006 | Yui | |
| 7,303,346 | B2 | 12/2007 | Ogi et al. | |
| 2005/0180779 | A1 | 8/2005 | Okamoto | |
| 2006/0182462 | A1 | 8/2006 | Imada et al. | |
| 2006/0193656 | A1 * | 8/2006 | Kumazawa | 399/121 |
| 2008/0002341 | A1 * | 1/2008 | Tomatsu | 361/679 |
| 2008/0003015 | A1 * | 1/2008 | Tomatsu | 399/110 |

FOREIGN PATENT DOCUMENTS

| | | | |
|---|---|---|---|
| CN | 1503067 | A | 6/2004 |
| CN | 1527070 | A | 9/2004 |
| JP | 57-5508 | U | 1/1982 |
| JP | 62-92309 | U | 6/1987 |

(Continued)

OTHER PUBLICATIONS

Initial Office Action for Chinese Application No. 2007-10129026.6 mailed Jun. 5, 2009 and English translation thereof.
US Office Action dtd 2010-04-26, USSN 11/758110.

*Primary Examiner*—David M Gray
*Assistant Examiner*—Ruth N Labombard
(74) *Attorney, Agent, or Firm*—Banner & Witcoff, Ltd.

(57) ABSTRACT

An image forming apparatus includes a process unit which has an image carrier and a scanner unit which exposes the image carrier to light, a pair of sheet metal frames which support and position the process unit and the scanner unit, and a pair of resin frames which support at least one module of the image forming apparatus other than the process unit and the scanner unit.

10 Claims, 7 Drawing Sheets

FOREIGN PATENT DOCUMENTS

| | | | |
|---|---|---|---|
| JP | 62-025404 | U | 7/1987 |
| JP | 4-012207 | A | 1/1992 |
| JP | 5-165264 | A | 4/1993 |
| JP | 5-188666 | A | 4/1993 |
| JP | 5-181326 | | 7/1993 |
| JP | 5-216347 | A | 8/1993 |
| JP | 5-307280 | A | 11/1993 |
| JP | 6-067503 | A | 3/1994 |
| JP | 6-051512 | U | 7/1994 |
| JP | 7-281580 | | 10/1995 |
| JP | 8-006385 | A | 1/1996 |
| JP | 8-087149 | A | 4/1996 |
| JP | 8-101546 | | 4/1996 |
| JP | 8-062920 | A | 8/1996 |
| JP | 8-262827 | A | 10/1996 |
| JP | 9-050157 | A | 2/1997 |
| JP | 9-141972 | A | 6/1997 |
| JP | 10-039577 | A | 2/1998 |
| JP | 10-123786 | A | 5/1998 |
| JP | 10-142875 | A | 5/1998 |
| JP | 10-161507 | A | 6/1998 |
| JP | 10-301421 | A | 11/1998 |
| JP | 11-119545 | A | 4/1999 |
| JP | 11-177254 | | 7/1999 |
| JP | 11-258885 | | 9/1999 |
| JP | 11-282251 | A | 10/1999 |
| JP | 2000-019930 | A | 1/2000 |
| JP | 2000-075772 | A | 3/2000 |
| JP | 2000-258715 | A | 9/2000 |
| JP | 2001-005285 | A | 1/2001 |
| JP | 2001-071584 | A | 3/2001 |
| JP | 2001-077548 | A | 3/2001 |
| JP | 2001-108072 | A | 4/2001 |
| JP | 2001-117305 | A | 4/2001 |
| JP | 2001-166550 | | 6/2001 |
| JP | 2001-246807 | A | 9/2001 |
| JP | 2001-296494 | A | 10/2001 |
| JP | 2002-009457 | A | 1/2002 |
| JP | 2002-021942 | A | 1/2002 |
| JP | 2002-040738 | A | 2/2002 |
| JP | 2002-149027 | A | 5/2002 |
| JP | 2002-149028 | A | 5/2002 |
| JP | 2002-244396 | A | 8/2002 |
| JP | 2002-311365 | A | 10/2002 |
| JP | 2002-341467 | A | 11/2002 |
| JP | 2003-307894 | | 10/2003 |
| JP | 2003-307894 | A | 10/2003 |
| JP | 2004-077788 | A | 3/2004 |
| JP | 2005-077637 | A | 3/2005 |
| JP | 2005-195946 | A | 7/2005 |
| JP | 2005-227603 | A | 8/2005 |

* cited by examiner

IMAGE FORMING APPARATUS

CROSS-REFERENCE TO RELATED APPLICATION

This application claims priority from Japanese Patent Application No. 2005-344330, filed on Nov. 29, 2005, the entire subject matter of which is incorporated herein by reference.

TECHNICAL FIELD

Aspects of the present invention relate to an electro-photographic image forming apparatus such as a laser printer.

BACKGROUND

An electro-photographic image forming apparatus includes a plurality of modules (elements) such as a sheet feed cassette, a belt which conveys a sheet, a process unit which has a photosensitive drum and a developing unit, a scanner unit which performs an exposure process, a transfer unit, a fixing unit, and a discharge unit which discharges the sheet. The image forming apparatus includes a pair of sheet metal frames disposed on both sides of the image forming apparatus. The modules are positioned and supported between the sheet metal frames (for example, see JP-A-8-101546). Since the sheet metal frames have a high rigidity, positional precision of the modules can be secured.

However, since it is difficult to machine the sheet metal frame in complex shapes, and the sheet metal frame has a low degree of freedom in design, it is difficult to efficiently arrange the modules in an apparatus. Thereby, the size of the apparatus may be enlarged. Further, additional attachment components for supporting the modules on the frames are required. Thus, production cost is increased.

SUMMARY

In order to solve such a problem, it can be considered to form the frame from a synthetic resin. It is easier to machine such a resin frame in complex shapes and the resin frame has a high degree of freedom in design. Accordingly, the modules are efficiently arranged by using the resin frame and the size of the apparatus can be reduced. However, since the resin frame has a low rigidity and can be easily deformed by means of thermal expansion, the positional precision of the modules may be deteriorated. Specifically, when the positional precision of the scanner unit or the process unit deteriorates, the quality of an image to be formed may be lowered.

Aspects of the invention provide an image forming apparatus which can reduce a size of an apparatus and secure image quality.

DETAILED DESCRIPTION

General Overview

Figure 1:
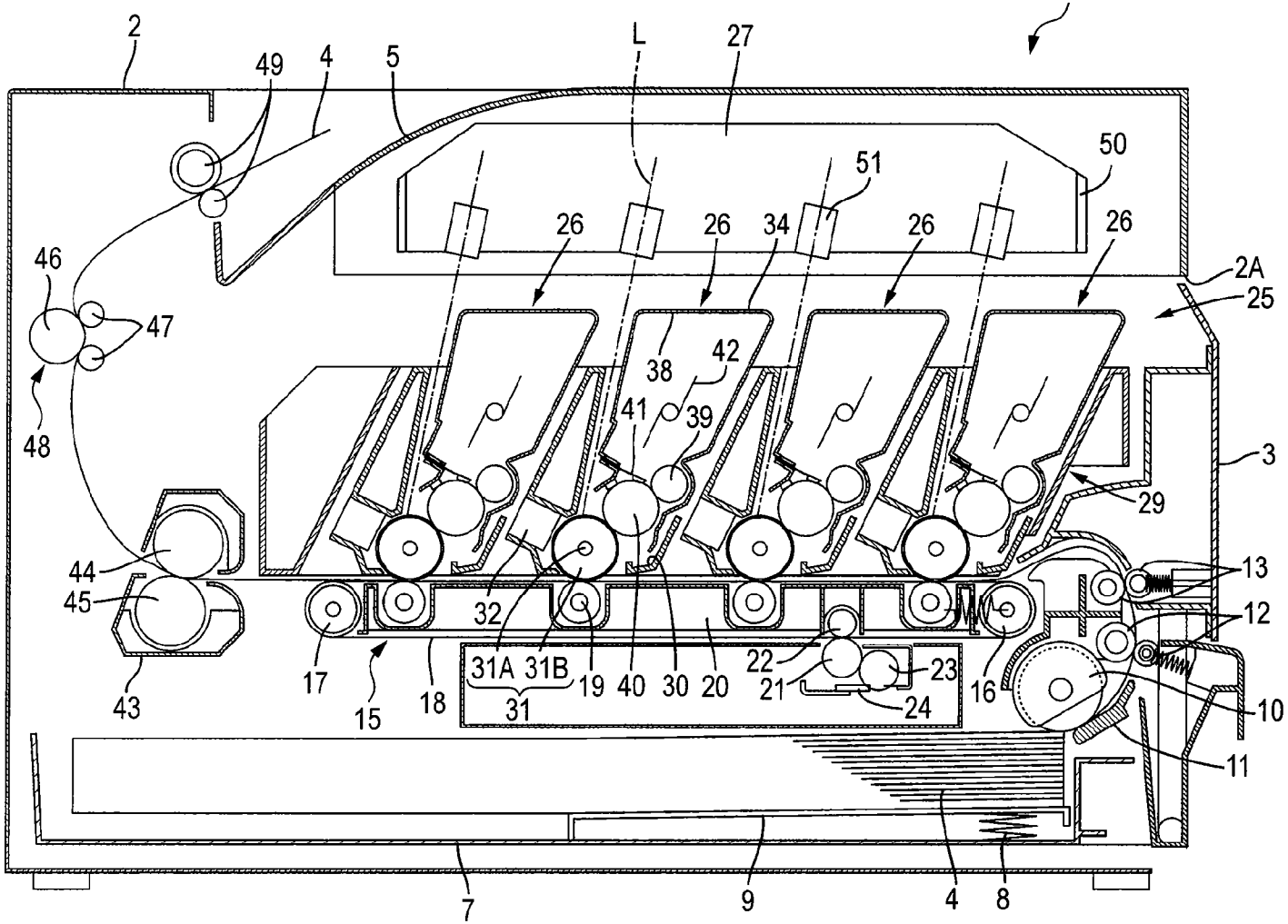
FIG. 1 is a side sectional view illustrating a laser printer according to an aspect of the invention.

According to a first aspect of the invention, there is provided an image forming apparatus comprising: a process unit which has an image carrier and a scanner unit which exposes the image carrier to light; a pair of sheet metal frames which support and position the process unit and the scanner unit; and a pair of resin frames which support at least one module of the image forming apparatus other than the process unit and the scanner unit.

According to a second aspect of the invention, the at least one module includes a belt which conveys a recording medium.

According to a third aspect of the invention, is the at least one module includes a loading cassette which loads a plurality of recording media and is capable of being drawn out from the image forming apparatus.

According to a fourth aspect of the invention, the at least one module includes a discharge unit which discharges a recording medium on which an image has been formed.

According to a fifth aspect of the invention, the at least one module includes a transfer unit which transfers a visible image to a recording medium.

According to a sixth aspect of the invention, the at least one module includes a fixing unit which fixes a visible image transferred to a recording medium.

According to a seventh aspect of the invention, each of the sheet metal frames includes: a process positioning portion which positions the process unit; and a scanner positioning portion which positions the scanner unit.

According to an eighth aspect of the invention, the process positioning portion and the scanner positioning portion are formed in the same plane of the sheet metal frame.

According to a ninth aspect of the invention, the sheet metal frames and the resin frames are at least partially superposed in a thickness direction.

According to a tenth aspect of the invention, the sheet metal frames are superposed on inner sides of the resin frames.

According to an eleventh aspect of the invention, the at least one module includes a belt which carries a visible image formed on the image carrier. By supporting the processing unit and the scanner unit in a positioned state by the sheet metal frame, high positional precision can be obtained, and image quality can be secured. By supporting the other modules not requiring high positional precision in a positioned state by the use of the resin frame having a high degree of freedom in design, the modules can be efficiently arranged and the size of the apparatus can be reduced.

By supporting the modules such as the belt unit, the loading cassette, the discharge unit, the transfer unit, and the fixing unit, of which high positional precision is not required, by the resin frame having a high degree of freedom in design, the modules can be efficiently arranged in the apparatus and the size of the apparatus can be reduced.

Since the scanner unit and the process unit are positioned in the same plane, the scanner unit and the process unit are not affected by a shaping error which occurs at the time of a bending work of the sheet metal. Accordingly, the positional precision of the scanner unit and the process unit can be increased and high image quality can be secured.

The sheet metal frame and the resin frame are superposed in the thickness direction. Accordingly, strength of the entire frame can be increased and deformation of the resin frame by the sheet metal frame can be suppressed.

<Illustrative Aspects>

Hereinafter, an aspect of the present invention will be described with reference to the drawings.

(Example Structure of Laser Printer)

Figure 2:
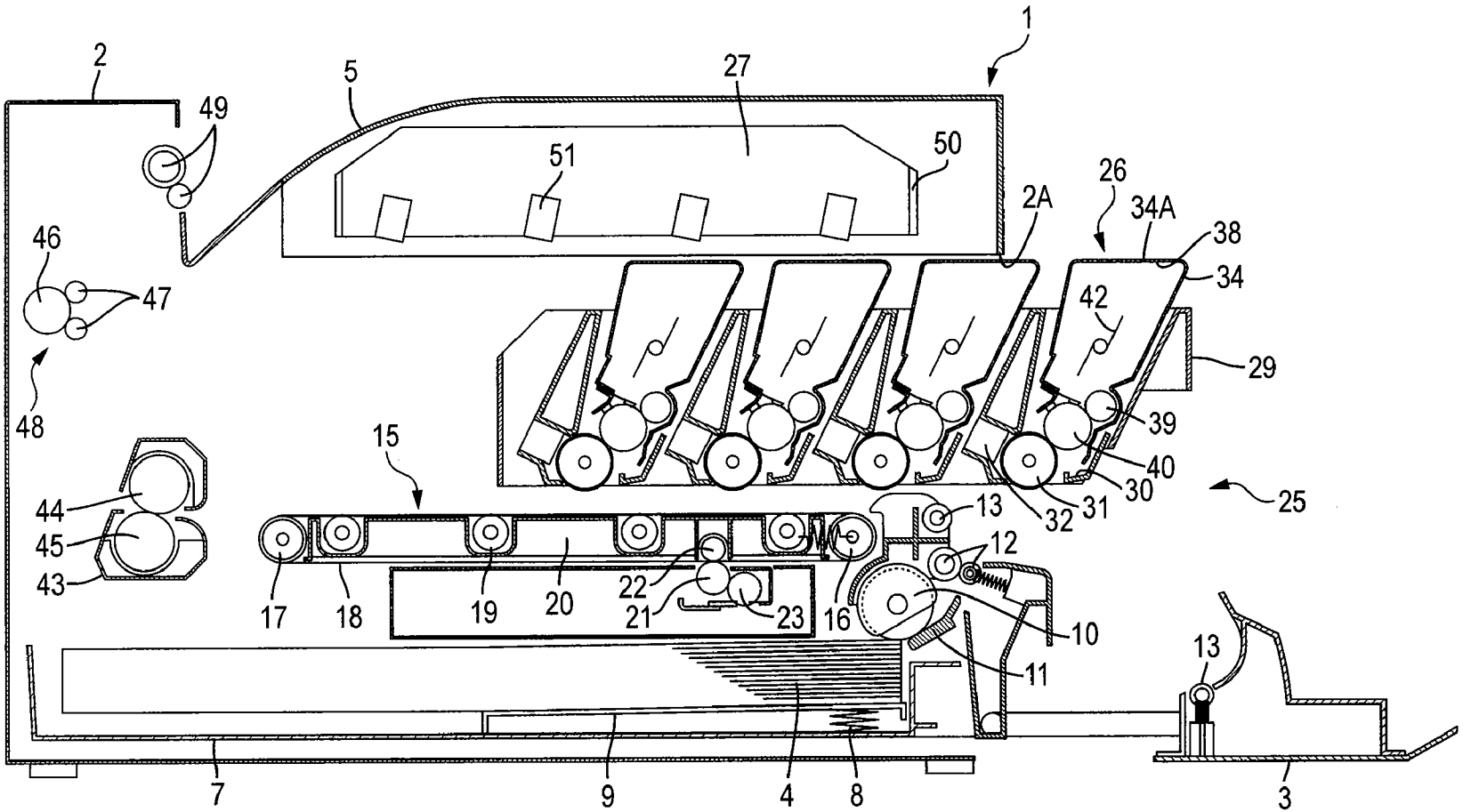
FIG. 2 is a side sectional view of the laser printer illustrating a state where a process unit is being drawn out.

FIG. 1 is a side sectional view of a laser printer 1 as an image forming apparatus according to an aspect of the invention. FIG. 2 is a side sectional view of the laser printer 1 in a state where a process unit 25 is being drawn out. In the following description, the right side in FIG. 1 denotes the front side.

The laser printer 1 is a direct transfer tandem type color laser printer. As shown in FIG. 1, the laser printer 1 includes a body casing 2 having a substantially box shape. A front cover capable of being opened and closed is disposed on the front surface of the body casing 2 and a process unit 25 can be drawn out inform the front side of the body casing 2 by opening the front cover 3 as shown in FIG. 2. A discharge tray 5, on which a sheet 4 (recording medium) having been subjected to image formation is stacked, is formed on the top surface of the body casing 2.

A sheet feed cassette 7 (loading cassette), on which the sheet 4 for forming an image is stacked, is mounted on a bottom surface of the body casing 2. A sheet pressing plate 9 is disposed in the sheet feed cassette 7. The sheet pressing plate 9 can be tilted so as to raise a leading end of the sheet 4 when a bias force if provided by a spring 8. A pickup roller 10 and a separation pad 11 are disposed at an upper position of a front end of the sheet feed cassette 7. The separation pad 11 is pressed into contact with the pickup roller 10 by a bias force of a spring (not shown). A pair of feed rollers 12 is disposed on the tilted front upper side of the pickup roller 10. A pair of resist rollers 13 is disposed above the feed rollers 12.

The uppermost sheet in the sheet feed cassette 7 is pressed to the pickup roller 10 by the sheet pressing plate 9. The uppermost sheet is separated from the remaining sheets when it is inserted between the pickup roller 10 and the separation pad 11 by the rotation of the pickup roller 10. The sheet 4 fed out from between the pickup roller 10 and the separation pad 11 is sent to the resist rollers 13. The resist rollers 13 feed the sheet 4 onto a belt unit 15 at a predetermined time.

The belt unit 15 can be attached to and detached from the body casing 2 and includes a belt frame 20. The belt frame 20 has a rectangular plate shape and is formed of a synthetic resin. The belt frame 20 is horizontally disposed in the body casing 2. Belt supporting rollers 16 and 17 are rotatably disposed on both front and rear ends of the belt frame 20. An endless convey belt 18 formed of a resin material such as polycarbonate is suspended over the belt supporting rollers 16 and 17. The convey belt 18 circulates in the counterclockwise direction of FIG. 1 with the rotation of the rear belt supporting roller 17 and conveys the trailing end of the sheet 4 placed thereon. The front belt supporting roller 16 (tension roller) can be displaced forwardly and backwardly. By biasing the front belt supporting roller forwardly, a tension is applied to the convey belt 18. The belt frame 20 is supported by four transfer rollers 19 rotatably disposed with a constant pitch in the forward and backward direction between the belt supporting rollers 16 and 17. The transfer rollers 19 are disposed opposite to a photosensitive drum 31 of each image forming unit 26 to be described later and the convey belt 18 is interposed between the photosensitive drum 31 and the transfer rollers 19. At the time of transfer, a transfer bias is applied across the transfer rollers 19 and the photosensitive drums 31.

A cleaning roller 21 for removing toner or paper dust adhered to the convey belt 18 is disposed below the belt unit 15. The cleaning roller 21 has a structure of a foam material made of silicon disposed around a metal shaft. The convey belt 18 is interposed between a metal backup roller 22 disposed in the belt unit 15 and the cleaning roller 21. A predetermined bias is applied across the cleaning roller 21 and the backup roller 22 to electrically attract the toner or dust on the convey belt 18 toward the cleaning roller 21. A metal collection roller 23 for removing the toner or dust attached to the surface of the cleaning roller abuts on the cleaning roller 21. A blade 24 for scraping off the toner or dust attached to the surface of the collection roller 23 abuts the collection roller 23.

A scanner unit 27 is disposed in the upper portion of the body casing 2. A process unit 25 is disposed below the scanner unit 27. The belt unit 15 is disposed below the process unit 25.

Although not shown in detail, the scanner unit includes four laser light-emitting portions, a polygon mirror, a scanner motor, a plurality of lenses and reflective mirrors in a flat box-shaped chassis 50. Four irradiation lenses 51 are provided on a bottom surface of the chassis 50. Color laser beams L emitted from the four laser light-emitting portions on the basis of predetermined image data are incident on the polygon mirror driven to rotate by the scanner motor at different incident angles through the lenses and reflective mirrors. The reflected laser beams L are emitted externally from the irradiation lenses 51 and are irradiated to the surfaces of the photosensitive drums 31.

The process unit 25 includes four image forming units 26 corresponding to magenta, yellow, cyan, and black. The image forming units 26 are arranged in parallel in an anteroposterior direction. Each image forming unit 26 includes a photosensitive drum 31 as an image carrier, a scorotron type charger 32, and a developing cartridge 34 as a developing unit. The process unit 25 includes a frame 29 having four cartridge mounting units 30 disposed in parallel in the anteroposterior direction. Each cartridge mounting unit 30 is opened upwardly and downwardly and the corresponding developing cartridge 34 can be attached to and detached from the inside thereof. In the frame 29, the photosensitive drums 31 of the image forming units 26 are held at lower end positions of the cartridge mounting units 30. The scorotron type charging units 32 are held adjacent to the photosensitive drums 31.

Each photosensitive drum 31 includes a metal drum shaft 31A to be grounded and a cylindrical drum body 315. An uppermost layer of the drum body 31B is formed of a positively charged photosensitive layer made of polycarbonate or the like. The drum body 31B is disposed around the drum shaft 31A and is rotatable about the drum shaft 31A.

The scorotron type charger 32 is disposed opposite to the photosensitive drum 31 with a predetermined gap. Thus, the scorotron type charger 32 does not contact with the photosensitive drum 31 in the tilted rear upper portion of the corresponding photosensitive drum 31. The scorotron type charger 32 uniformly charges the surface of the photosensitive drum 31 with positive charge by generating corona discharge from a charging wire (not shown) made of tungsten or the like.

The developing cartridge 34 has a substantially box shape. Toner receiving chambers 38 are disposed in an upper portion of the inside of the developing cartridge 34. A supply roller 39, a developing roller 40 and a thickness-control blade 41 are disposed in a lower side of the developing cartridge 34. Positively charged non-magnetic toners of yellow, magenta, cyan and black as developers are received in the toner receiving chambers 38. An agitator 42 for agitating the toner is disposed in each toner receiving chamber 38.

The supply roller 39 has a structure in that a metal roller shaft is coated with a conductive foam material. The developing roller 40 has a structure that a metal roller shaft is coated with a conductive rubber material. The toner supplied from the toner receiving chambers 38 is supplied to the developing roller 40 with the rotation of the supply rollers 39 and is charged to a positive charge between the supply roller 39 and the developing roller 40. The toner advances between the thickness-control blade 41 and the developing roller 40 with the rotation of the developing roller 40 and is sufficiently charged therein. The toner is held on the developing roller 40 as a thin layer with a constant thickness.

The surface of the photosensitive drum 31 is uniformly charged to a positive charge by the scorotron type charger 32 at the time of rotation thereof. Thereafter, the surface of the photosensitive drum 31 is exposed to light by high-speed scanning of a laser beam from the scanner unit 27. Thus, an electrostatic latent image corresponding to an image to be formed on the sheet 4 is formed thereon.

When the toner held on the developing roller 40 comes in contact with the photosensitive drum 31 with the rotation of the developing roller 40, the toner is supplied to the electrostatic latent image formed on the surface of the photosensitive drum 31. Accordingly, the electrostatic latent image on the photosensitive drum 31 is visualized. Further, a toner image in which the toner is attached to only the exposed portion is formed on the photosensitive drum 31.

Thereafter, the toner image formed on the surface of each photosensitive drum 31 is transferred to the sheet 4 by a negative transfer bias applied to the transfer rollers 19 while the sheet 4 conveyed by the convey belt 18 passes through transfer positions between the photosensitive drums 31 and the transfer rollers 19. The sheet 4 to which the toner images are transferred is conveyed to the fixing unit 43.

The fixing unit 43 is disposed in the back of the convey belt 18 in the body casing 2. The fixing unit 43 includes a heating roller 44 and a pressing roller 45. The heating roller has a heat source such as a halogen lamp and is rotatable. The pressing roller 45 is oppositely disposed below the heating roller 44 to press the heating roller 44 and rotates with the rotation of the heating roller. The fixing unit 43 fixes the toner images onto the sheet 4 by heating the sheet 4 holding four color toner images while interposing and conveying the sheet 4 between the heating roller 44 and the pressing roller 45.

A discharge unit 48 includes a convey roller 46 driven to rotate, a pair of driven rollers 47 disposed opposite thereto and a guide (not shown) for guiding the sheet 4 on the tilted rear upper side of the fixing unit 43. The heat fixed sheet 4 is conveyed to a discharge rollers 49 disposed in the upper portion of the body casing 2 by the discharge unit 48 and is discharged onto the discharge tray 5 by the discharge rollers 49.

(Support Structure of Body Frame)

Next, structures for supporting the units using a body frame 55 will be described in detail.

Figure 3:
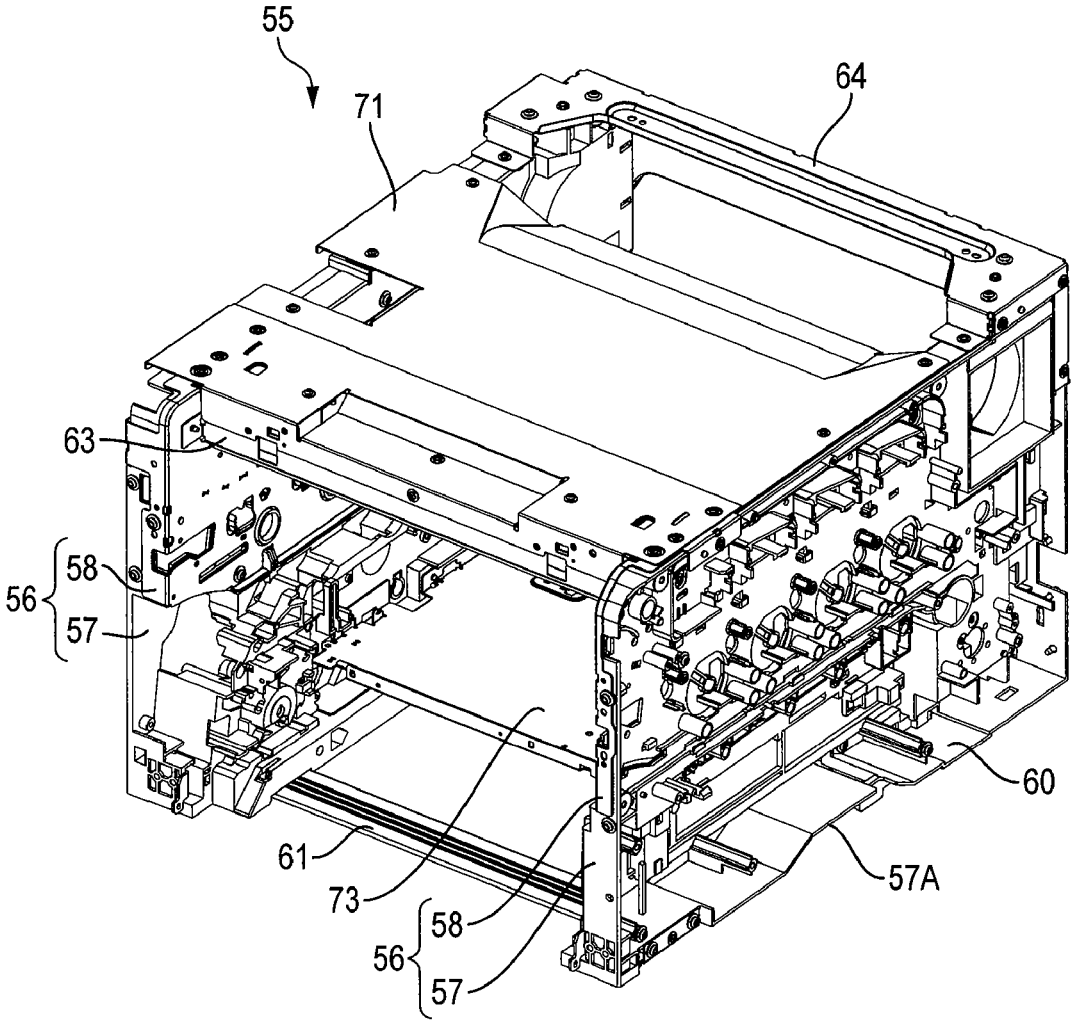
FIG. 3 is a perspective view of a body frame.
Figure 4:
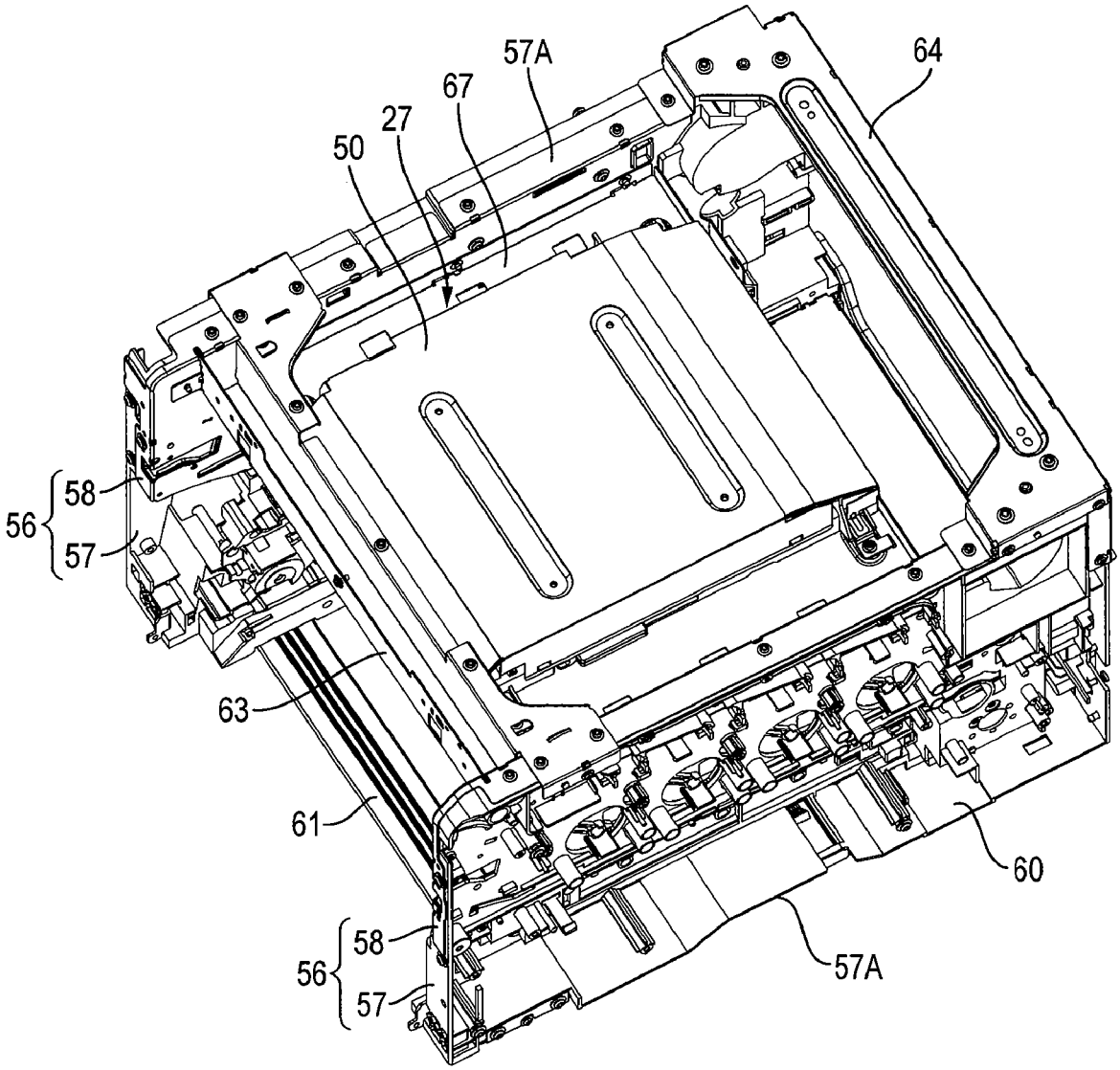
FIG. 4 is a perspective view illustrating a state where a part of a front beam and a top plate are detached from the body frame.
Figure 5:
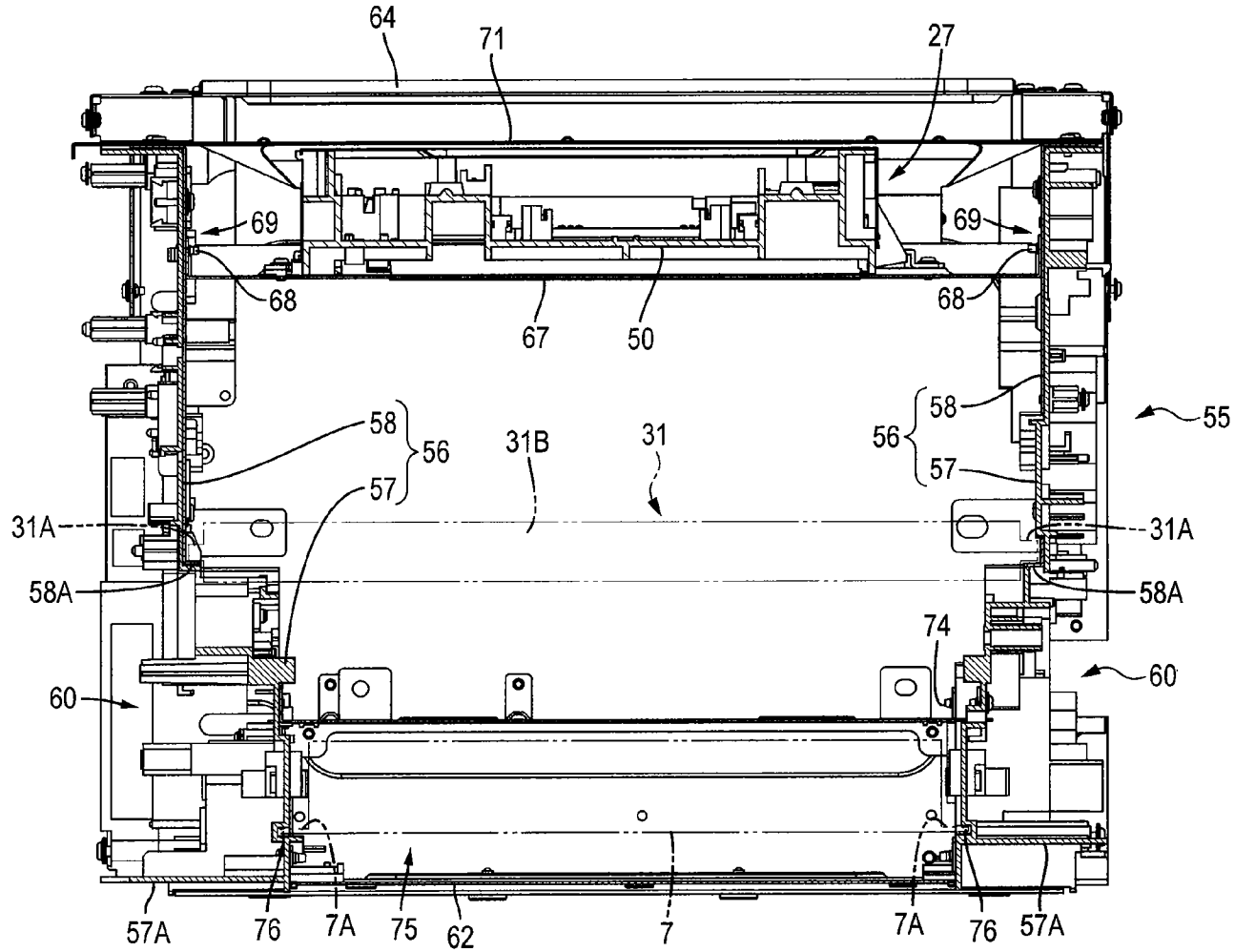
FIG. 5 is a front sectional view of the body frame.
Figure 6:
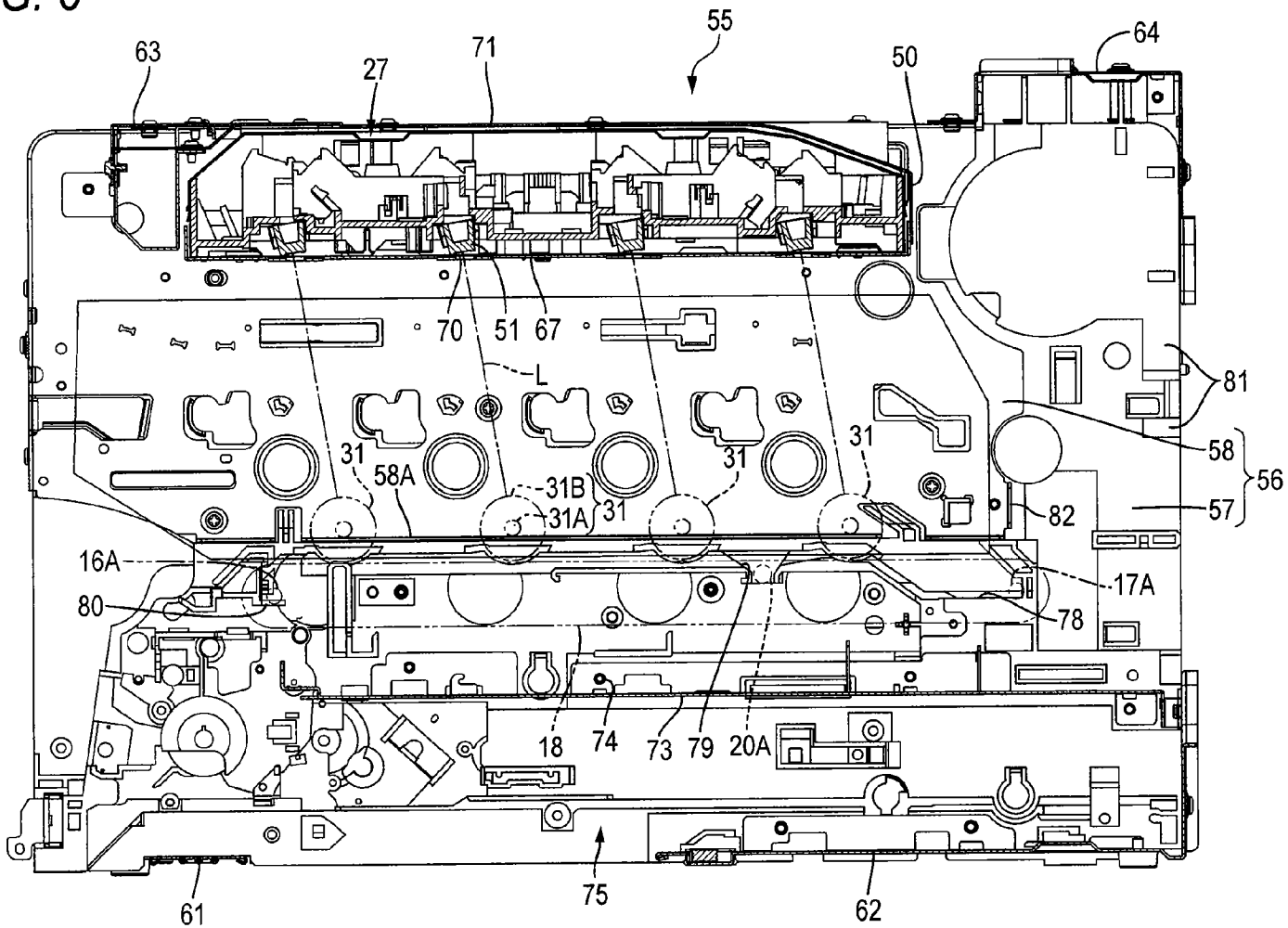
FIG. 6 is a side sectional view of the body frame.
Figure 7:
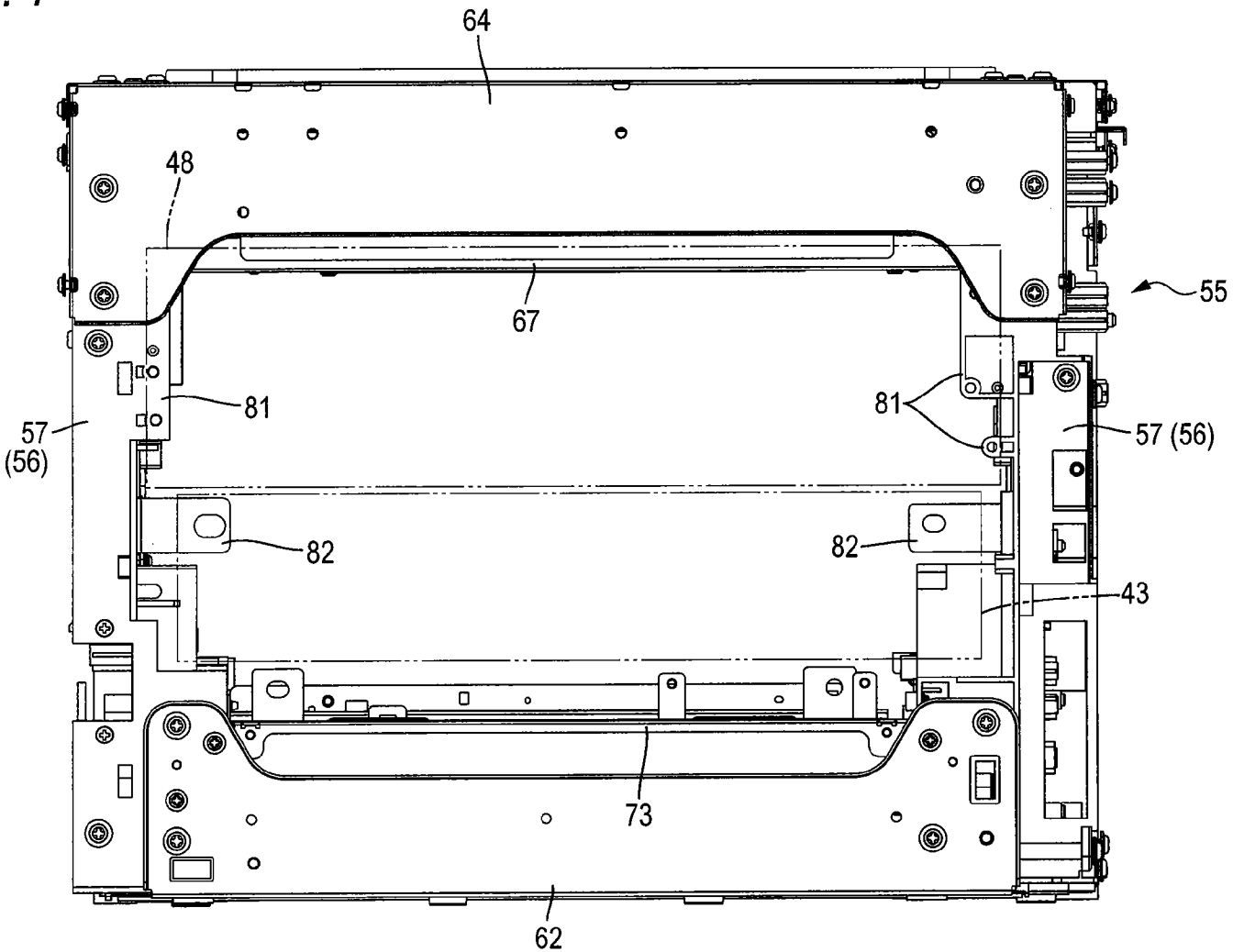
FIG. 7 is a rear side view of the body frame.

FIG. 3 is a perspective view illustrating the body frame 55. FIG. 4 is a perspective view illustrating a state where a part of a front beam 43 and a top plate 71 are detached from the body frame 55. FIG. 5 is a front sectional view of the body frame 55. FIG. 6 is a side sectional view of the body frame 55. FIG. 7 is a rear view of the body frame 55. In FIG. 6, the left side denotes the front side.

The above-mentioned body casing 2 includes the body frame 55 and a resin outer cover covering a part of the outer surface of the body frame 55. A variety of modules such as the process unit 25, the scanner unit 27, the sheet feed cassette 7, the belt unit 15, the discharge unit 48 and the fixing unit 43 constituting the laser printer 1 are supported by the body frame 55. The body frame 55 has a rectangular shape of which the front and rear sides are opened as a whole and includes a pair of side walls 56, as shown in FIGS. 3 and 5. Each side wall 56 includes a sidewall resin frame 57 (resin frame) made of a synthetic resin and a sidewall sheet metal frame 58 (sheet metal frame). Sidewall resin frames 57 form a substantially rectangular shape in the side view, the peripheral portion 57A of which extends outwardly, and has a receiving concave portion 60. Although not shown in detail, a gear mechanism, etc. for delivering power from a main motor to the units are disposed in the receiving concave portion 60. The sidewall sheet metal frames 58 are superposed on the sidewall resin frames 57 in the thickness direction on the inside and the sidewall sheet metal frames 58 and sidewall resin frames 57 are fixed to each other.

A metal bottom beam 61 is disposed between the sidewalls 56 in a position close to a front end of a bottom of the body frame 55. A bottom plate 62 obtained by bending a metal plate in a substantially L shape is provided in a position close to a back end of the bottom of the body frame 55.

As shown in FIG. 4, a metal front beam 63 is disposed between the sidewalls 56 in a front end of a top of the body frame 55. A metal rear beam 64 having a substantially L shape is disposed between the sidewalls 56 in a rear end of the top of the body frame 55. Between the sidewalls 56, a metal scanner supporting plate 67 is horizontally disposed between the front beam 63 and the rear beam 64. The scanner supporting plate 67 has a rectangular shape and four sides thereof are bent upwardly. As shown in FIG. 5, both lateral ends thereof are fixed to the inner surfaces of the sidewalls 56 by the use of a fastener 68. The chassis 50 of the scanner unit 27 is placed on the scanner supporting plate 67 and is fixed thereto with a screw. That is, the scanner unit 27 is supported in a positioned state by the sidewall sheet metal frames 58 with the scanner supporting plate 67 therebetween. The positions of the sidewall sheet metal frames 58 to which the fastener 68 is attached serve as scanner positioning portions 69. In the scanner supporting plate 67, slits 70 for transmitting the laser beam L are formed along the lateral direction at positions corresponding to the irradiation lenses 51 of the scanner unit 27. On the top surface of the body frame 55, a metal top plate 71 is disposed between the sidewalls 56 so as to cover the top side of the scanner unit 27.

On the bottom of the body frame 55, as shown in FIGS. 5 and 6, a metal bedplate 73 is disposed above the bottom plate 62. Both sides of the bedplate 73 are fixed to the sidewall resin frames 57 by a fastener 74 and are disposed horizontally and disposed in regions other than the front portion of the body frame 55. The region surrounded with the bedplate 73, the bottom plate 62 and the both sidewall resin frames 57 serves as a cassette receiving portion 75 and receives a portion other than the front portion of the sheet feed cassette 7. In both sidewall resin frames 57, guide grooves 76 are formed in the forward and backward direction at positions opposite to the cassette receiving portion 75. By inserting ribs 7A protruding from the side surfaces of the sheet feed cassette 7 into the guide grooves 76, the sliding motion in the forward and backward direction of the sheet feed cassette 7 is guided and the sheet feed cassette 7 is positioned and supported in the vertical direction.

The lower edges 58A (process positioning portions) of the sidewall sheet metal frames 58 are bent inwardly at a right angle at positions having a constant height. When the process unit 25 is mounted onto the body casing 2, an end of the drum shaft 31A of each photosensitive drum 31 is placed on the lower edges of the sidewall sheet metal frames 58. Thus, the photosensitive drums (process unit 25) are positioned vertically. In this way, the position at which the lower edges 58A are formed and the position at which the scanner positioning portion 69 is formed are flush with each other in the sidewall sheet metal frames 58. Compared with a case where the sheet metal is bent, for example, in a stepped shape between the lower edges 58A and the scanner positioning portions 69, the aspect of the invention is not affected by shaping error resulting from the bending work of manufacturing the sheet metal. Thus, the positional precision of the photosensitive drums (process unit 25) and the scanner unit 27 is enhanced.

Three belt unit supporting portions 78, 79 and 80 are formed in the forward and backward direction below the lower edges of the sidewall sheet metal frames 58 in both sidewall resin frames 57 as shown in FIG. 6. The rear belt unit supporting portion 78 forms a groove shape opened toward the tilted front upper portion and is fitted with a bearing member 17A mounted to an end of a rotation axis of the rear belt supporting roller 17. The center belt unit supporting portion 79 forms a groove shape opened upwardly and is fitted with a positioning protrusion 20A protruding from both side surfaces of the belt frame 20. The front belt unit supporting portion 80 forms a horizontal plate shape and is fitted with a bearing member 16A mounted to an end of a rotation axis of the front belt supporting roller 16. The belt unit 15 (including the transfer roller 19) is positioned and supported in the vertical direction and the horizontal direction by the belt unit supporting portions 78, 79 and 80.

As shown in FIG. 7, discharge unit attaching portions 81 protrude inwardly integrated with the rear ends of the sidewall resin frames 57. The discharge unit 48 is screwed to the discharge unit attaching portions 81. Thus, the discharge unit 48 is positioned and supported.

Fixing unit attaching portions 82 protrude inwardly from the rear ends of the sidewall sheet metal frames 58. The fixing unit 43 is screwed to the fixing unit attaching portion 82. Thus, the fixing unit 43 is positioned and supported.

(Advantages)

According to this aspect of the invention, by supporting the process unit 25 and the scanner unit 27 in a positioned state by using the sidewall sheet metal frames 58 from which high positional precision can be obtained, image quality can be secured. By supporting the modules such as the belt unit 15, the sheet feed cassette 7, the discharge unit 48 and the transfer roller 19 which not require high positional precision by using the sidewall resin frames 57 having a high degree of freedom in design, the modules can be efficiently arranged. Accordingly, the size of the laser printer 1 can be reduced.

Since the scanner unit 27 and the process unit 25 are positioned in the same plane of the sidewall sheet metal frame 58, the scanner unit and the process unit are not affected by a shaping error resulting from the bending work of forming a sheet metal. Accordingly, the positional precision of the scanner unit 27 and the process unit 25 can be increased. Accordingly, high image quality can be secured.

Since the sidewall sheet metal frames 58 and the sidewall resin frames 57 are superposed in the thickness direction in the sidewall 56, the strength of the entire sidewalls can be increased and deformation due to thermal expansion of the sidewall resin frames 57 can be suppressed by the sidewall sheet metal frames 58.

(Other Aspects)

The invention is not limited to the aspect described above with reference to the drawings, but the following aspects can be included in the technical scope of the invention. The invention may be modified in various forms without departing from the scope of the invention, in addition to the following aspects.

Although it has been described in the above aspect that the fixing unit is supported by the sheet metal frames, the fixing unit may be supported by the resin frames. Some of the modules such as the sheet feed cassette, the belt unit and the discharge unit may be supported by the sheet metal frame. The transfer unit may also be supported by the sheet metal frame. Thus, the positional precision of the transfer unit can be enhanced. Accordingly, color deviation resulting in deviation in transfer position can be prevented.

Although it has been described that the above aspect is applied to the color laser printer of a direct transfer tandem type, the aspect may be applied to an image forming apparatus of an intermediate transfer tandem type or an image forming apparatus of four cycle type (single drum type). The aspect may be applied to an image forming apparatus of a monochrome type.

Although it has been described in the above aspect that a plurality of photosensitive drums are provided as the image carrier, a photosensitive belt suspended across a plurality of rollers may be provided as the image carrier.

Although it has been described in the above aspect that the convey belt conveying a recording medium is provided as a belt, an intermediate transfer belt may be provided as the belt.

What is claimed is:

1. An image forming apparatus comprising:
a process unit which has an image carrier;
a scanner unit which exposes the image carrier to light;
a pair of sheet metal frames which support and position the process unit and the scanner unit; and
a pair of resin frames which support at least one module of the image forming apparatus other than the process unit and the scanner unit.

2. The image forming apparatus according to claim 1, wherein the at least one module includes a belt which conveys a recording medium.

3. The image forming apparatus according to claim 1, wherein the at least one module includes a loading cassette which loads a plurality of recording media and is configured to be drawn out from the image forming apparatus.

4. The image forming apparatus according to claim 1, wherein the at least one module includes a discharge unit which discharges a recording medium on which an image has been formed.

5. The image forming apparatus according to claim 1, wherein the at least one module includes a transfer unit which transfers a visible image to a recording medium.

6. The image forming apparatus according to claim 1, wherein the at least one module includes a fixing unit which fixes a visible image transferred to a recording medium.

7. The image forming apparatus according to claim 1, wherein each of the sheet metal frames includes:
a process positioning portion which positions the process unit; and
a scanner positioning portion which positions the scanner unit.

8. The image forming apparatus according to claim 7, wherein the process positioning portion and the scanner positioning portion are formed in the same plane of the sheet metal frame.

9. The image forming apparatus according to claim 1, wherein the sheet metal frames and the resin frames are at least partially superposed in a thickness direction.

10. The image forming apparatus according to claim 9, wherein the sheet metal frames are superposed on inner sides of the resin frames.

* * * * *